US005580107A

United States Patent [19]

Howell

[11] Patent Number: 5,580,107

[45] Date of Patent: Dec. 3, 1996

[54] HIDDEN LATCH HOOK FOR PORTABLE PERSONAL COMPUTER AND THE LIKE

[75] Inventor: Bryan Howell, Austin, Tex.

[73] Assignee: Dell U.S.A., L.P.

[21] Appl. No.: 533,049

[22] Filed: Sep. 25, 1995

[51] Int. Cl.[6] ..... E05C 19/12

[52] U.S. Cl. ..... 292/95; 292/125

[58] Field of Search ..... 292/95, 109, 110, 292/113, 121, 122, 123, 125, 194; 364/708.1; 220/326, 260, 263, 264, 324; 190/119

[56] References Cited

U.S. PATENT DOCUMENTS

| | | | |
|---|---|---|---|
| 4,476,994 | 10/1984 | Hope et al. . | |
| 4,571,456 | 2/1986 | Paulsen et al. | 179/2 C |
| 4,730,364 | 3/1988 | Tat-Kee | 16/337 |
| 4,758,031 | 7/1988 | Wolf . | |
| 4,901,261 | 2/1990 | Fuhs | 364/708.1 |
| 5,021,922 | 6/1991 | Davis et al. | 361/380 |
| 5,175,672 | 12/1992 | Conner et al. | 361/393 |
| 5,333,116 | 7/1994 | Hawkins et al. | 364/708.1 |

*Primary Examiner*—Steven N. Meyers
*Assistant Examiner*—Donald J. Lecher
*Attorney, Agent, or Firm*—Haynes and Boone, L.L.P.

[57] ABSTRACT

An improved latch hook mechanism for portable PCs and the like is disclosed. In a preferred embodiment, a portable PC latch mechanism of the present invention comprises a latch assembly including a latch hook disposed on the exterior of the bezel portion of the lid of the PC and connected to an arm of approximately the same length as the latch hook via a longitudinally disposed spring member, both of which are disposed within the interior of the lid. The spring member defines an axis about which the latch hook and the arm may be caused to rotate relative to one another when force is applied to the free end of the arm. One end of a ribbon cable is connected to the free end of the arm. The remainder of the cable is arranged such that it extends down the interior of the lid of the PC through one of the hinges connecting the lid to the base of the PC and is secured to the rear interior of the base via a hook or screw. The cable is of a length sufficient so as not to exert force on the arm when the lid is in an open position such that when the lid is in an open position, the latch hook rests in a recess provided in the bezel of the lid such that the latch hook lies flush with the surface of the lid. The cable is further of a length such that as the lid is rotated to a closed position, increasing force is applied by the cable to the arm of the latch assembly such that the latch hook is caused to rotate out of the recess for engagement with a receptacle in the base.

19 Claims, 3 Drawing Sheets

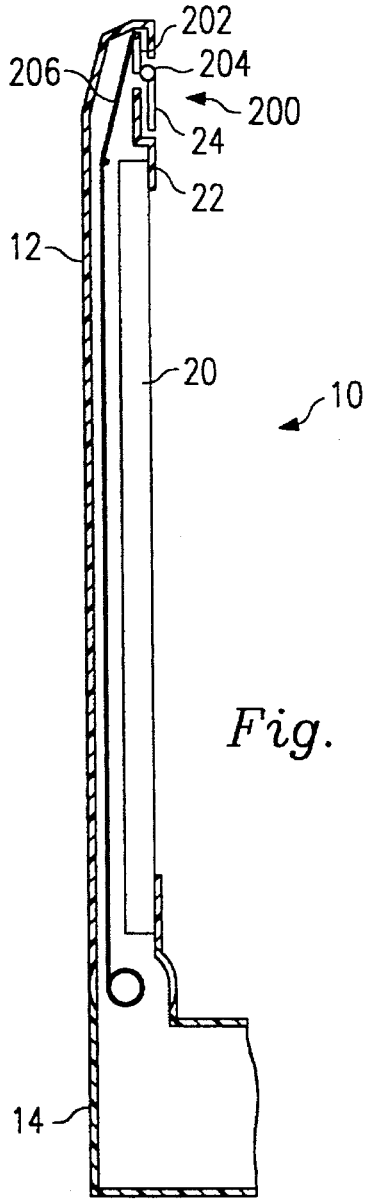
*Fig. 5*
*Fig. 6*
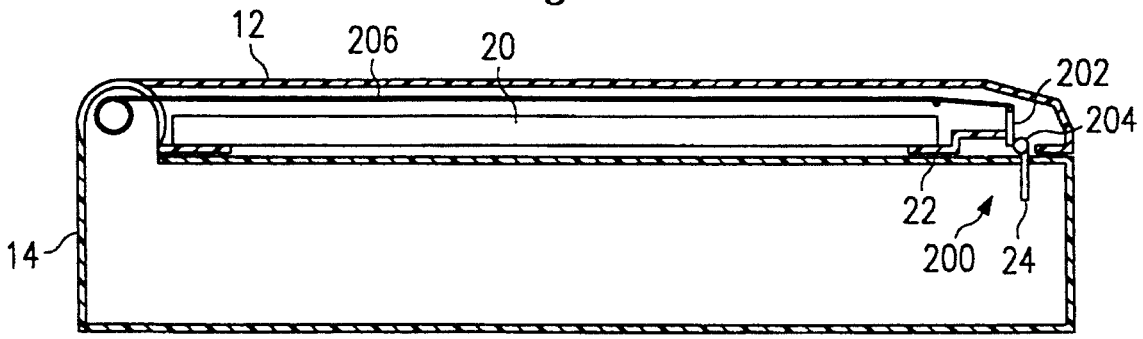

HIDDEN LATCH HOOK FOR PORTABLE PERSONAL COMPUTER AND THE LIKE

TECHNICAL FIELD

The invention relates to latch hooks used to secure the top shell of a case to the bottom shell thereof and, more particularly, to latch hooks used on portable personal computers.

BACKGROUND OF THE INVENTION

Over the past few years there has been widespread development of portable personal computers ("PCs"). These portable PCs are typically about the size of small portable typewriters. The display is contained on the lid which folds down flat on the base containing the keyboard.

Portability of such PCs requires that the lid and the base be securely latched. It is also desirable that the latch hook does not protrude from the sides of the computer. Protrusions are not only unsightly, but also potentially dangerous. A protruding hook may result in the hook's being accidentally sheared off when it comes in contact with some other object. Also, if the latch is accidentally slammed on a finger or hand or catches on clothing, it can cause injury or damage, leaving a negative impression on the user.

Prior attempts to address these problems have been only partly satisfactory. For example, in U.S. Pat. No. 4,571,456 to Paulson, et al., a locking mechanism is illustrated between the lid assembly and the keyboard that includes a linearly reciprocal hook-like lug in the lid and a cooperating undercut recess on the keyboard. The engaging faces on the hook lug and recess are complementary but angled and thus tend to cam the lug out of the recess. Also, in both U.S. Pat. No. 4,758,031 to Wolf, which discloses a retractable safety latch and in U.S. Pat. No. 4,901,261 to Fuhs, which discloses a retractable handle and latch, the latching mechanisms are located on the outer side of the PC and therefore detract from the aesthetic appeal of the PC. Furthermore, the latch disclosed in U.S. Pat. No. 4,758,031 to Wolf, although partially retractable, is not flush with the surface of the PC when the PC is open.

Therefore, what is needed is a latch mechanism for a portable PC that does not protrude from the PC when the PC is open.

SUMMARY OF THE INVENTION

The present invention, accordingly, provides a latch mechanism that overcomes the problems associated with prior latch mechanisms. With the above background in mind, it is among the primary objectives of the present invention to provide an improved latch mechanism for use with a portable PC.

In a preferred embodiment, a portable PC latch mechanism of the present invention comprises a latch assembly including a latch hook disposed on the exterior of the bezel portion of the lid of the PC and connected to an arm of approximately the same length as the latch hook via a longitudinally disposed spring member, both of which are disposed within the interior of the lid. The spring member defines an axis about which the latch hook and the arm may be caused to rotate relative to one another when force is applied to the free end of the arm. One end of a cable, preferably a ribbon-type cable, is connected to the free end of the arm. The remainder of the cable is arranged such that it extends down the interior of the lid of the PC, behind an LCD retained therein, through one of the hinges connecting the lid to the base of the PC, preferably along the same path as the LCD cable, and is secured to the rear interior of the base via appropriate means, such as a hook or screw.

In one aspect of the invention, the cable is of a length sufficient so as not to exert force on the arm when the lid is in an open position. Accordingly, when the lid is in an open position, the latch hook rests in an appropriately shaped recess provided in the bezel of the lid such that the latch hook lies flush with and does not protrude from the surface of the lid.

In another aspect of the invention, the cable is also of a length such that the closing of the lid pulls the cable taut. Accordingly, as the lid is rotated to a closed position, increasing force is applied to the arm of the latch assembly such that the latch hook is caused to rotate about the spring member such that it protrudes from the recess in which it is retained for engagement with a receptacle in the base.

In one embodiment, a conventional latch hook release mechanism, such as a slidable release button, is also provided to enable the user to free the latch hook from the receptacle, thereby to open the PC.

A technical advantage achieved with the invention is that it provides a latch hook that is flush with the surface of the PC when the lid is open, thereby increasing the aesthetic appeal of the PC and preventing the latch hook from being accidentally sheared off when it comes in contact with another object.

Another technical advantage achieved with the invention is that it prevents accidental damage to property or injury to person that may be caused by contact with a protruding hook when the PC is opened.

BRIEF DESCRIPTION OF THE DRAWINGS

FIG. 5 is a partial side sectional view of the PC of FIGS. 1A and 1B wherein the lid thereof is open.

FIG. 6 is a side sectional view of the PC of FIGS. 1A and 1B wherein the lid thereof is closed.

DESCRIPTION OF THE PREFERRED EMBODIMENTS

Figure 1A:
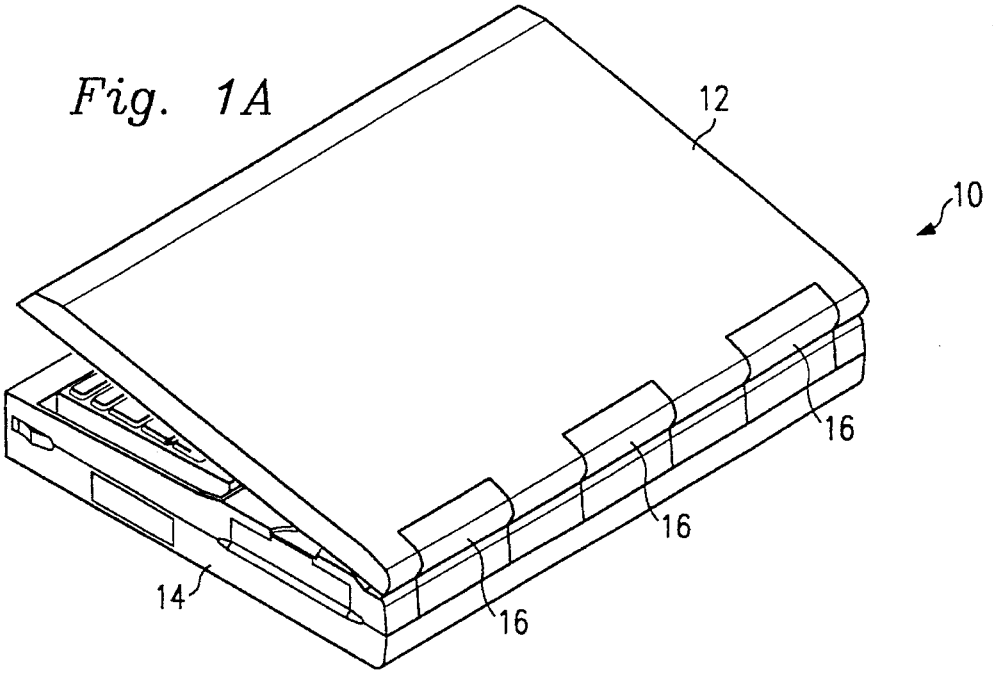
FIG. 1A is a rear perspective view of a portable PC embodying features of the present invention.
Figure 1B:
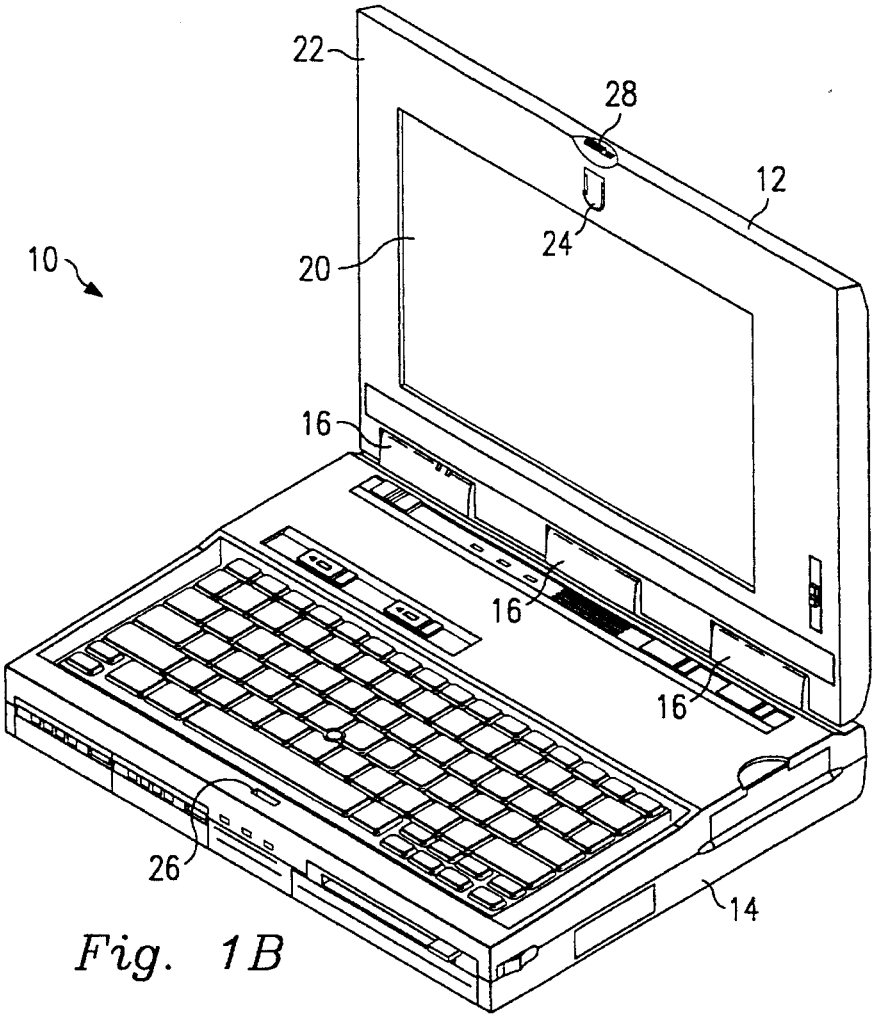
FIG. 1B is a front perspective view of the portable PC of FIG. 1A.

FIGS. 1A and 1B are, respectively, rear and front perspective views of a portable PC 10 embodying features of the present invention. The PC 10 comprises a lid 12 rotatably connected to a base 14 via one or more hinges 16 such that the lid 12, and hence the PC 10, may be opened and closed by a user's rotating the lid 12 about the hinges 16 relative to the base 14. As shown in FIG. 1B, a liquid crystal display (LCD) 20 is retained within the lid 12 by a bezel 22. In addition, as will be described in further detail below, a recess (FIG. 3) is provided in the bezel 22 for retaining a latch hook 24 such that, when the lid 12 is in an open position, the latch hook 24 lies flush with the surface of the bezel 22. As will also be described, when the lid 12 is rotated to a closed position, the latch hook 24 is caused to rotate to a position in which it protrudes from the recess (FIG. 3), and hence the bezel 22, for mating with a receptacle 26 provided on the top surface of the base 14. A conventional latch hook release mechanism, such as a slidable release button 28, is also provided to enable the user to free the latch hook 24 from the receptacle 26, thereby to open the PC 10.

Figure 2:
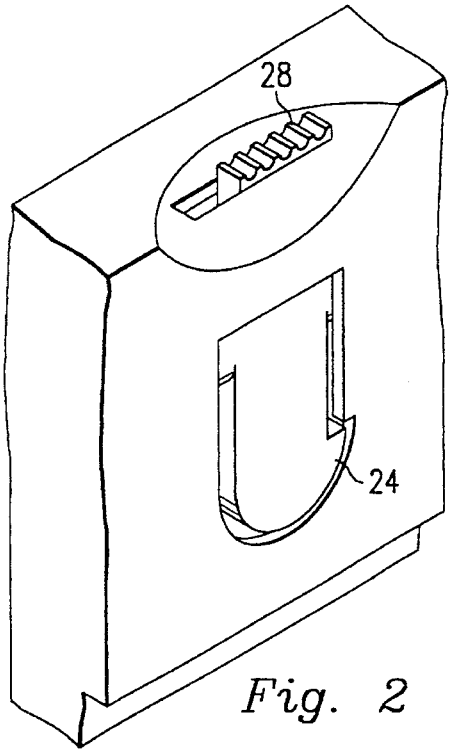
FIG. 2 is a perspective view of the latch assembly of the PC of FIGS. 1A and 1B showing the latch hook in a recessed position.
Figure 3:
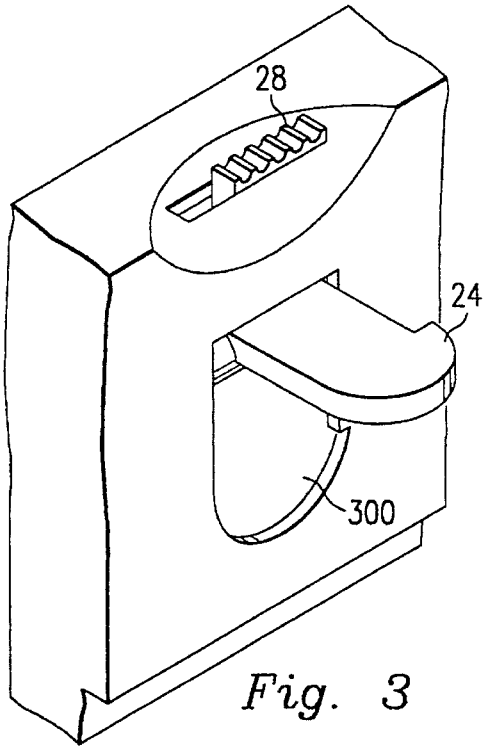
FIG. 3 is a perspective view of the latch assembly shown in FIG. 2 showing the latch hook in an extended position.

FIGS. 2 and 3 respectively illustrate the latch hook 24 retained within and protruding from the recess 300 in recessed (FIG. 2) and extended (FIG. 3) positions.

Figure 4:
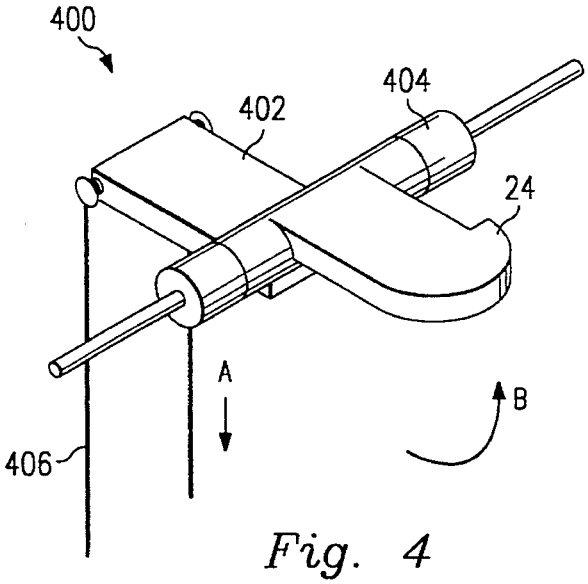
FIG. 4 is a more detailed illustration of the latch assembly shown in FIGS. 2 and 3.

As shown in FIG. 4, a latch assembly 400 of the present invention comprises the latch hook 24 connected to an arm 402 of approximately the same length as the latch hook 24 via a longitudinally disposed spring member 404. As will be shown, in FIGS. 5 and 6, the spring member 404 defines an axis about which the latch hook 24 and the arm 402 may rotate relative to one another when force is applied to the arm 402. The spring 404 also provides a mechanism by which the latch hook 24 may be released from the receptacle 26 using the release button 28 in a manner that is well known in the art. One end of a cable 406, preferably a ribbon-type cable, is connected to the free end of the arm 402. Referring now also to FIG. 5, the cable 406 is positioned such that it extends down the lid 12 behind the LCD 20, through one of the hinges 16, preferably along the same path as the LCD cable (not shown), and is secured to the rear interior of the base 24 via appropriate means, such as a hook or screw.

As shown in FIG. 4, when a force is exerted on the cable 406 in the direction indicated by an arrow A, the latch hook 24 is caused to rotate about the spring member 404 in a direction indicated by an arrow B such that the latch hook 24 protrudes from the recess 300. Referring to FIGS. 5 and 6, the cable 406 is of a length sufficient so as not to exert force on the arm 402 when the lid 12 is opened, so that the latch hook 24 is retained within the recess 300 and does not protrude from the surface of the lid 12, as illustrated in FIG. 2. However, as the lid 12 is rotated to a closed position, as illustrated in FIG. 6, the cable 406 is drawn taut, thereby exerting sufficient force on the arm 402 to cause the latch hook 24 to rotate out from the recess 300, as illustrated in FIG. 3, such that it may engage the receptacle 26.

It is understood that the present invention can take many forms and embodiments. The embodiments shown herein are intended to illustrate rather than to limit the invention, it being appreciated that variations may be made without departing from the spirit of the scope of the invention. For example, the latch hook 24 may be of any number of shapes known to be suitable for serving as a latch hook 24. Moreover, more than one latch assembly 400 may be provided for retaining the lid 12 in a closed position relative to the base 14.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. A latch mechanism for securing a portable PC comprising:

a lid;

a base;

at least one hinge, said lid being rotatably mounted on said base via said at least one hinge;

a rotatable latch assembly comprising a latch hook;

a recess disposed on a front surface of said lid, wherein when said lid is in an open position, said latch hook lies within said recess and flush with said front surface of said lid; and a mechanical assembly connected to said rotatable latch assembly for rotating said rotatable latch assembly relative to said lid when said lid is moved from an open position to a closed position, thereby causing said latch hook to rotate relative to said lid and to protrude from said recess for engagement with a latch receptacle disposed on a top surface of said base.

2. The latch mechanism of claim 1 wherein said mechanical assembly comprises:

a cable having first and second ends, said first end for connection to said rotatable latch assembly and said second end for connection to an interior wall of said base; and means for securing said second end to said interior wall of said base.

3. The latch mechanism of claim 2 wherein said portable PC further comprises a liquid crystal display ("LCD") retained within said lid and wherein said cable extends from said latch assembly, behind said LCD, through one of said at least one hinge, to said interior wall of said base.

4. The latch mechanism of claim 1 wherein said rotatable latch assembly further comprises a spring member connected to said latch hook and disposed within said lid and an arm member connected to said spring member opposite said latch hook and disposed within said lid; and wherein said mechanical assembly is connected to said arm for causing said rotatable latch assembly to rotate about an axis defined by said spring member.

5. The latch mechanism of claim 4 further comprising a release mechanism connected to said spring member for releasing said latch hook from said latch receptacle when said lid is in said closed position.

6. The latch mechanism of claim 2 wherein said securing means comprises a hook.

7. The latch mechanism of claim 2 wherein said securing means comprises a screw.

8. A latch mechanism for a portable PC comprising:

a lid;

a base;

at least one hinge, said lid rotatably mounted on said base via said at least one hinge;

rotatable latching means comprising an interior portion disposed within said lid and an exterior portion disposed on a front exterior surface of said lid;

means for retaining said exterior portion flush with a front surface of said lid when said lid is in an open position; and means connected to said rotatable latching means for rotating said rotatable latching means relative to said lid when said lid is moved from an open position to a closed position, thereby causing said exterior portion to rotate relative to said lid and to protrude from said retaining means for engagement with receptacle means disposed on a top surface of said base.

9. The latch mechanism of claim 8 wherein said rotating means comprises:

a cable having first and second ends, said first end for connection to said rotatable latching means and said second end for connection to an interior wall of said base; and means for securing said second end to said interior wall of said base.

10. The latch mechanism of claim 9 wherein said portable PC further comprises a liquid crystal display ("LCD") retained within said lid and wherein said cable extends from said latch assembly, behind said LCD, through one of said at least one hinge, to said interior wall of said base.

11. The latch mechanism of claim 8 wherein said exterior portion of said rotatable latching means comprises a latch hook and said interior portion of said rotatable latching means comprises a spring member connected to said latch hook and disposed within said lid and an arm member connected to said spring member opposite said latch hook and disposed within said lid; and wherein said mechanical assembly is connected to said arm for causing said rotatable latching means to rotate about an axis defined by said spring member.

12. The latch mechanism of claim 8 further comprising means connected to said rotatable latching means for disengaging said exterior portion from said receptacle means when said lid is in said closed position.

13. The latch mechanism of claim 9 wherein said securing means comprises a hook.

14. The latch mechanism of claim 9 wherein said securing means comprises a screw.

15. A latch mechanism for securing a portable PC comprising:

a lid;

a base;

at least one hinge, said lid being rotatably mounted on said base via said at least one hinge;

a rotatable latch assembly comprising:

a latch hook;

a spring member connected to said latch hook and disposed within said lid; and an arm member connected to said spring member opposite said latch hook and disposed within said lid;

a recess disposed on a front surface of said lid, wherein when said lid is in an open position, said latch hook lies within said recess and flush with said front surface of said lid;

a mechanical assembly connected to said arm of said rotatable latch assembly for rotating said rotatable latch assembly responsive to movement of said lid to a closed position about an axis defined by said spring member, thereby causing said latch hook to protrude from said recess for engagement with a latch receptacle disposed on a top surface of said base; and a release mechanism connected to said spring member for releasing said latch hook from said latch receptacle when said lid is in said closed position.

16. The latch mechanism of claim 15 wherein said mechanical assembly comprises:

a cable having first and second ends, said first end for connection to said rotatable latch assembly and said second end for connection to an interior wall of said base; and means for securing said second end to said interior wall of said base.

17. The latch mechanism of claim 16 wherein said portable PC further comprises a liquid crystal display ("LCD") retained within said lid and wherein said cable extends from said latch assembly, behind said LCD, through one of said at least one hinge, to said interior wall of said base.

18. The latch mechanism of claim 16 wherein said securing means comprises a hook.

19. The latch mechanism of claim 16 wherein said securing means comprises a screw.

* * * * *